US006431525B1

(12) United States Patent
Roll

(10) Patent No.: US 6,431,525 B1
(45) Date of Patent: Aug. 13, 2002

(54) PAWL AND RATCHET ASSEMBLY FOR WINCH MECHANISM

(75) Inventor: Michael J. Roll, Wausau, WI (US)

(73) Assignee: Fulton Performance Products, Inc., Mosinee, WI (US)

( * ) Notice: Subject to any disclaimer, the term of this patent is extended or adjusted under 35 U.S.C. 154(b) by 0 days.

(21) Appl. No.: 09/611,863

(22) Filed: Jul. 7, 2000

Related U.S. Application Data

(60) Provisional application No. 60/144,109, filed on Jul. 16, 1999.

(51) Int. Cl.[7] ..... B66D 1/14

(52) U.S. Cl. ..... 254/357; 74/411.5

(58) Field of Search ..... 254/223, 247, 254/310, 357, 345, 376, 380; 188/82.3, 82.2, 82.34, 82.7; 74/411.5

(56) References Cited

U.S. PATENT DOCUMENTS

| | | | | |
|---|---|---|---|---|
| 993,409 A | | 5/1911 | Roderick | |
| 2,747,838 A | * | 5/1956 | Riemann | 254/357 |
| 2,849,089 A | | 8/1958 | Lindmark | |
| 2,891,824 A | * | 6/1959 | Fulton | 254/357 |
| 2,943,710 A | | 7/1960 | Lindmark | |
| 3,005,621 A | * | 10/1961 | Johnson et al. | 254/376 |
| 3,049,338 A | | 8/1962 | Beebe | |
| 3,101,927 A | * | 8/1963 | Gray | 188/82.3 |
| 3,765,652 A | * | 10/1973 | Janik | 254/376 |
| 3,939,729 A | | 2/1976 | Brockelsby | |
| 4,030,704 A | | 6/1977 | Beierle et al. | |
| 4,106,754 A | | 8/1978 | Kucher | |
| 4,261,222 A | | 4/1981 | Dattilo | |
| 4,346,630 A | | 8/1982 | Hanson | |
| 4,468,005 A | | 8/1984 | Nakamura | |
| 4,475,854 A | | 10/1984 | Ericsson | |
| 4,566,674 A | | 1/1986 | Ebey et al. | |
| 4,660,702 A | | 4/1987 | Flotow | |
| 4,692,825 A | | 9/1987 | Debaudringhien | |
| 5,647,576 A | * | 7/1997 | Kataoka | 254/357 |
| 6,116,580 A | * | 9/2000 | Hull | 254/357 |

* cited by examiner

*Primary Examiner*—Emmanuel M. Marcelo
(74) *Attorney, Agent, or Firm*—Robert H. Earp, III; McDonald, Hopkins, Burke and Haber LPA

(57) ABSTRACT

A winch mechanism that is capable of sustained, heavy load operation comprises a frame, a ratchet, and a pawl for cooperative engagement with a pinion and a drum gear. The frame includes a plurality of apertures positioned proximate to the pawl axle, one aperture for each mode of operation of the winch mechanism. Pawl position relative to the pinion is defined by the position of a ratchet plug and the apertures in the frame. The winch mechanism includes a forward-engaged mode, a reverse-engaged mode, and a free-spooling mode. A wave washer urges the ratchet plug into one of the apertures once the ratchet mode is determined.

15 Claims, 4 Drawing Sheets

PAWL AND RATCHET ASSEMBLY FOR WINCH MECHANISM

RELATED APPLICATIONS

This application claims priority from U.S. Provisional Application No. 60/144,109 filed on Jul. 16, 1999.

FIELD OF ART

This invention relates to a heavy-duty winch mechanism for hoisting heavy loads, such as a boat or trailer, onto a platform.

BACKGROUND OF THE INVENTION

Winch mechanisms are commonly used to hoist heavy loads. The winch is generally constructed such that the handle is connected through a pinion gear to a drum gear that is affixed to a drum. The pinion gear increases the torque capacity that an operator can handle.

A reversible ratchet mechanism is selectively operable to restrict reel rotational movement in one direction while enabling rotation of the reel in the opposite direction. The pawl and ratchet arrangement can be selectively operable into a forward-engaged mode, a reverse-engaged mode, and a free-spooling mode.

The pawl includes two gear-engaging teeth that alternately engage a pinion, permitting the gear to be rotated either clockwise or counterclockwise depending upon pawl engagement against the pinion. When one pawl tooth engages against the pinion, the winch mechanism may be operated only in the forward direction. Upon engagement of the other pawl tooth against the pinion, the winch mechanism is operable only in the reverse direction. When the pawl is pivoted into the free-spooling mode, the drum gear is operated freely in either the forward or reverse direction. The gears become reengaged by axially sliding the pinion gear back into position.

While conventional systems provide various modes of operation, such mechanisms are generally unstable and are subject to unwanted shifting of gear modes, often causing personal injury and property damage.

What is needed is a winch mechanism that has enhanced bracketry, that is capable of sustaining heavy loads, that may be readily and easily reversed by one operator, and that is capable of operating in forward-engaged, reverse-engaged, and free-spooling modes.

What is needed is a winch mechanism that minimizes the risk of personal injury and the likelihood of damaging the objects being hoisted, that enables easy pivotal rotation of the reel, that is less likely to be inadvertently switched out of engagement, and that is simple, compact, and durable.

SUMMARY OF THE INVENTION

All of the above needs are addressed by the winch mechanism of the present invent. The winch mechanism of the present invention comprises a powdered-metal pawl that is secured to the ratchet lever with an extension spring and biased into position relative to the frame. A wave washer pushing laterally against the ratchet lever holds the ratchet lever in its selected mode.

The ratchet pawl, which determines the direction of ratcheting of the input gear, is connected to a ratchet arm by an extension spring. The ratchet arm is movable through three modes by a détente engagement between a ratchet plug and the winch frame. The ratchet plug engages one of three apertures in the frame, one aperture for each position of the winch mechanism.

The ratchet lever has three modes: one mode for each ratcheting direction and one for a non-ratcheting option. The ratchet arm is moved into position manually and aligns a ratchet plug with an aperture in the winch frame to determine gear engagement.

For a more complete understanding of the winch mechanism of the present invention, reference is made to the following detailed description and accompanying drawings in which the presently preferred embodiment of the invention is shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE DRAWINGS

DETAILED DESCRIPTION OF THE PREFERRED EMBODIMENT

Figure 1:
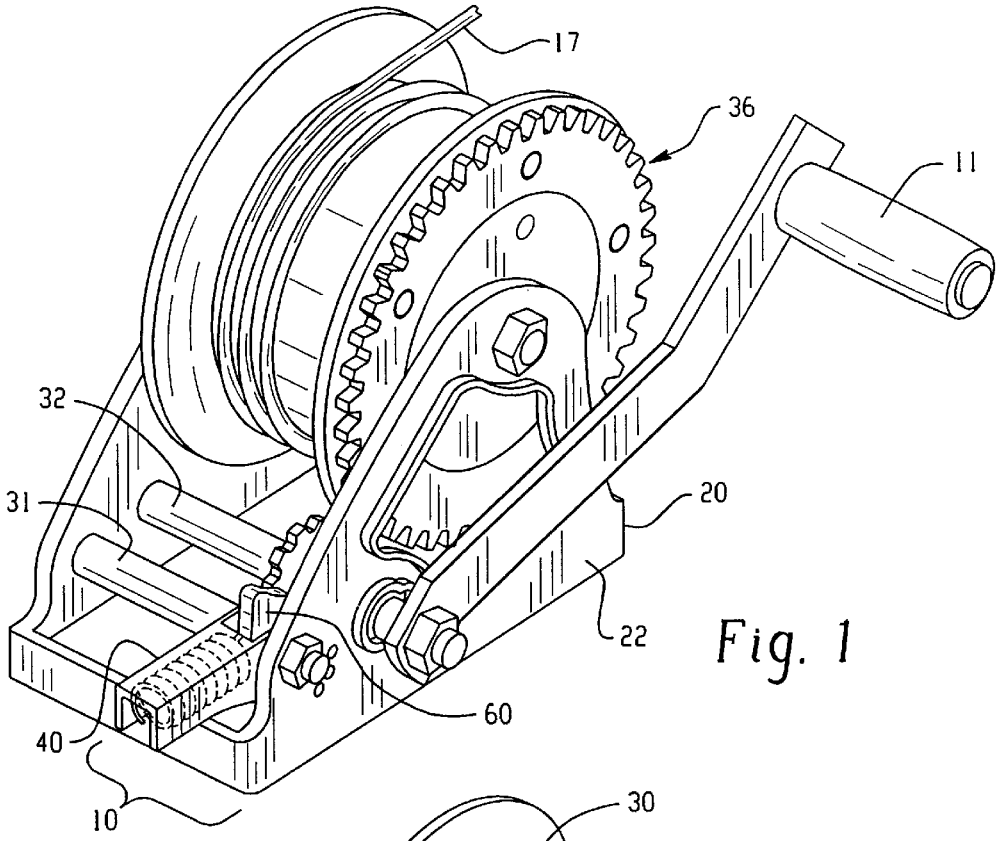
FIG. 1 is a perspective view of the preferred embodiment of the winch mechanism of the present invention.

Referring now to the drawings, FIG. 1 discloses the preferred embodiment of the winch mechanism 10 of the present invention. The winch mechanism 10 includes two engaged modes; one mode enabling rotation of the pinion gear in a clockwise direction, and the other mode enabling rotation of the pinion gear in a counterclockwise direction. The winch mechanism 10 also includes a free-spooling mode that enables disengaged drum gear rotation in both directions.

Figure 2:
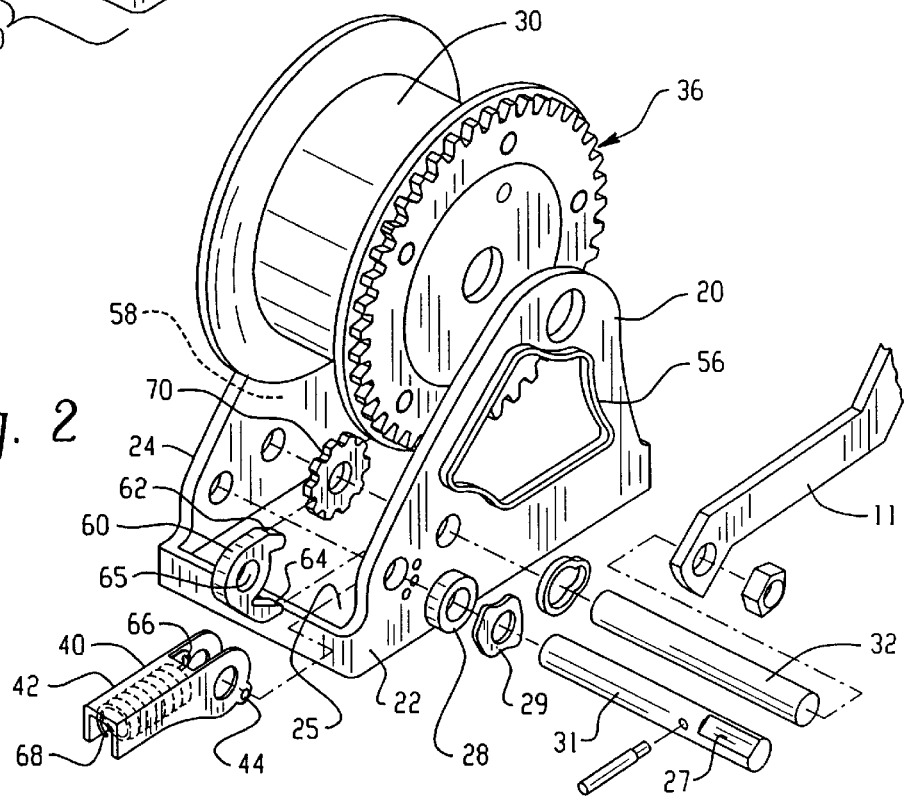
FIG. 2 is an assembly view of the preferred embodiment of the winch mechanism of FIG. 1.

As shown in FIG. 2, the winch mechanism 10 of the present invention includes a frame 20, a ratchet 40, and a pawl 60 as hereinafter set forth.

The winch frame 20 is preferably a one-piece unit and includes a pair of parallel sidewalls 22 and 24 surrounding a base 25. Three parallel axles extend across the winch frame 20 and through the parallel sidewalls 22 and 24: (1) the pawl 60 is mounted within the ratchet 40 on a ratchet-pawl axle 31; (2) the pinion gear 70 and winch handle are mounted on a pinion-gear axle 32; and (3) the drum gear 36 is mounted onto a drum gear axle 33 of a drum 30. The drum gear 36 is continuously meshed with the pinion gear 70, since both the pinion-gear axle 32 and the drum-gear axle 33 are fixed in the sidewalls 22 and 24 of the winch frame 20.

The winch frame includes two covers (not shown) disposed on the outer surface of the drum gears 36, that protect the drum gears 36 from damage. The pawl 60, ratchet-pinion axle 32, and pinion gear 70 are preferably made of a powdered-metal material.

Each sidewall 22 and 24 includes embossments 56 and 58 that increases the strength of the frame 20. The embossments 56 and 58 are positioned between the pinion-gear axle 32 and the drum axle 33, where the stress on the frame sidewalls 22 and 24 have the most mass. The winch frame 20 is formed by a stamping operation with a punch press. The embossments 56 and 58 increase the load capacity of the winch mechanism 10 by fifteen to twenty percent from static capacity.

Figure 8:
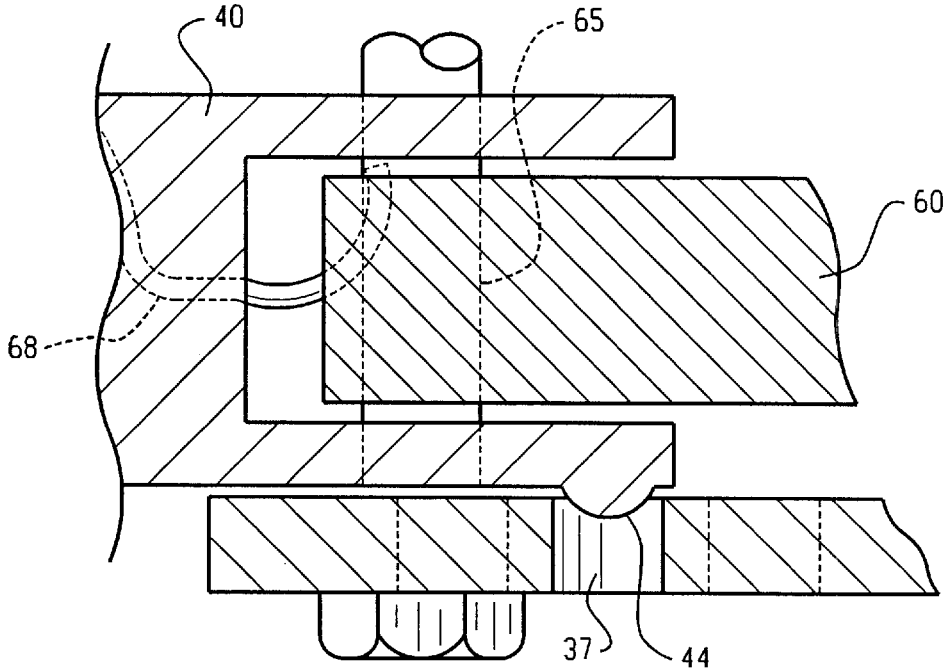
FIG. 8 is an exploded top view of FIG. 4, depicting the engagement between the ratchet plug and one of the apertures in the frame.

The ratchet 40 includes a ratchet arm 42 and a ratchet plug 44. The ratchet arm 42 enables repositioning of the pawl 60 relative to the pinion gear 70. Proximate to the ratchet-pawl axle 31 in one of the sidewalls 22 is disposed three discrete apertures 37, 38, and 39; one for each mode of the winch mechanism 10 of the present invention. As depicted in FIG. 8, the ratchet plug 44 enables détente engagement of the ratchet 40 with each of the three apertures 37, 38, and 39 in the sidewall 22 of the winch frame 20.

Figure 5:
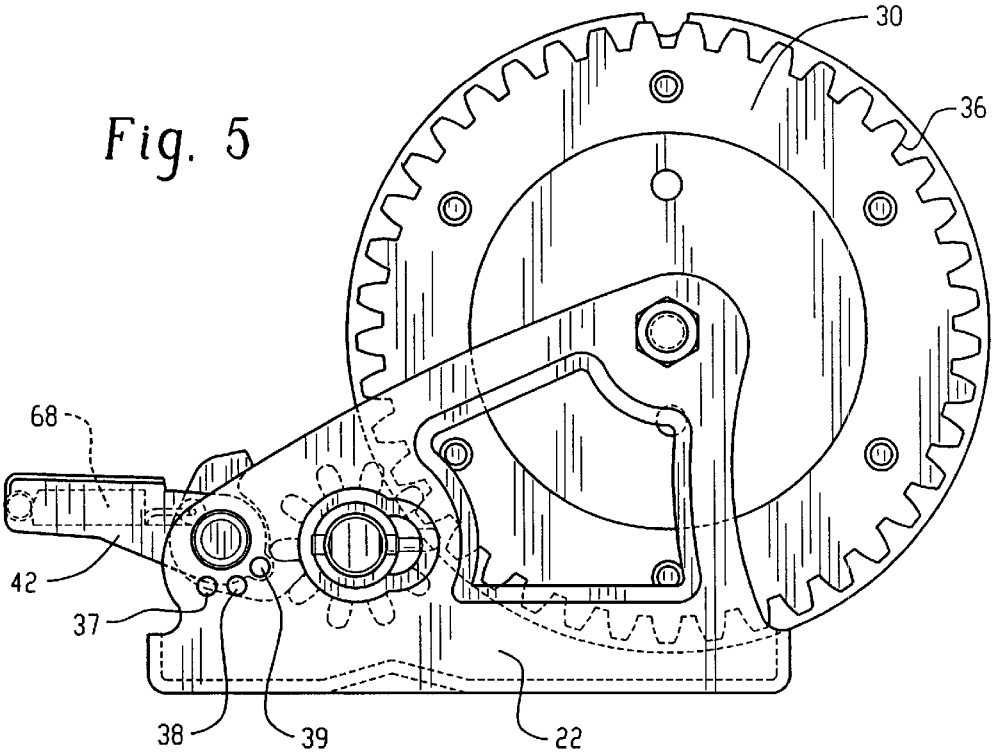
FIG. 5 is a side elevational view of the preferred embodiment of the winch mechanism of FIG. 4, the ratchet being in the engaged mode enabling only reverse rotation of the pinion gear.
Figure 7:
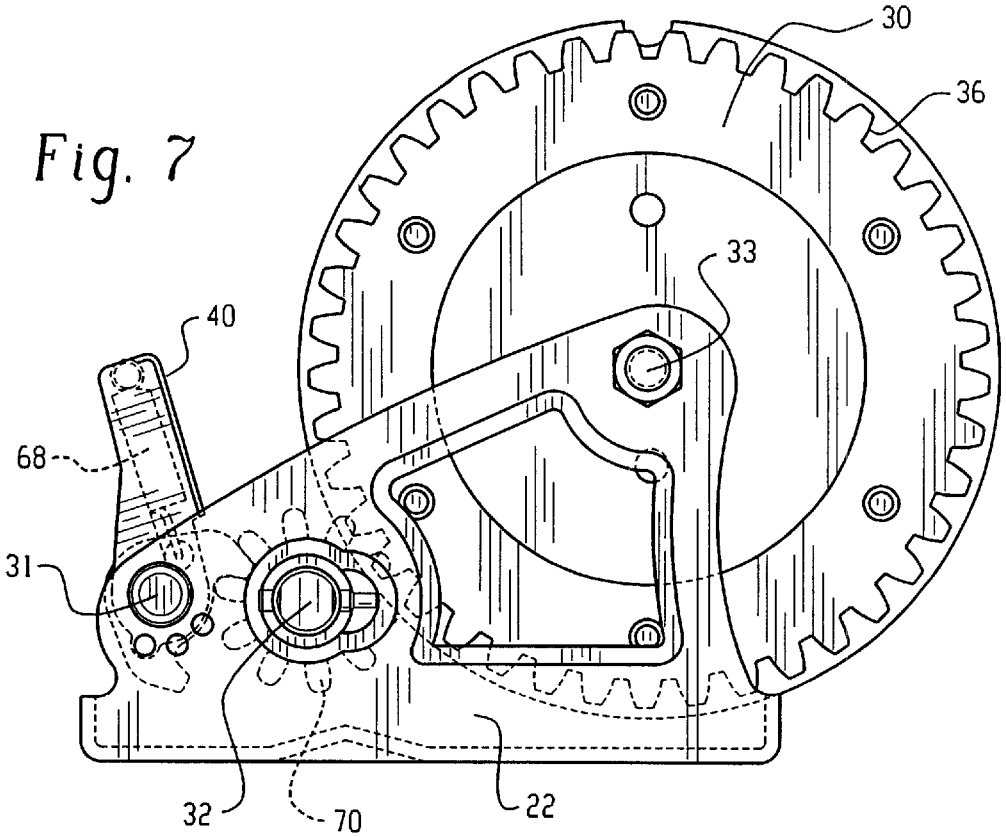
FIG. 7 is a side elevational view of the preferred embodiment of the winch mechanism of FIG. 3, the ratchet being in the engaged mode enabling only forward rotation of the pinion gear.

The pawl 60 has two angularly spaced teeth 62 and 64 formed at comers thereof. Each of the teeth are shaped to mesh between two teeth of the pinion gear 70. When the upper pawl tooth 62 is in cooperative engagement with the pinion gear 70, a forward or clockwise rotation of the pinion gear 70 is enabled while blocking a counterclockwise rotation. When the lower tooth 64 is in cooperative engagement with the pinion gear 70, a reverse rotation of the pinion gear 70 is enabled while blocking a clockwise rotation. The angle between the pawl teeth 62 and 64 is preferably between 90 and 150 degrees. When one pawl tooth is in active engagement with the pinion gear 70, the inactive pawl tooth is out of such engagement. The pawl 60 pivots between the reverse (counterclockwise) engaged mode and the forward (clockwise) engaged mode as shown in FIGS. 5 and 7. Each of the pawl teeth 62 and 64 ride into and out of engagement with the teeth of the pinion gear 70. The ratchet 40 surrounds the pawl 60 to prevent inadvertent repositioning of the pawl 60.

A hole is disposed through the pawl 60, the hole 65 being axially aligned with a central opening 62. A coil spring 68 is positioned between the ratchet 40 and the pawl 60 to urge the pawl 60 into the position with the ratchet 40. One end of the coil spring 68 is affixed to the end of the ratchet arm 42, while the other end is affixed to the pawl hole 65. The pawl hole 65 is preferably offset from the center of the pawl 60 to provide additional tension of the coil spring 68 and the pawl 60.

One end of the ratchet-pawl axle 31 has an intermediate flattened edge A bushing 28 is positioned so as to abut against the intermediate flattened edge 27. Disposed between the bushing 28 and an interior sidewall 22 of the winch frame 20 is a wave washer 29. The wave washer 29 has waves disposed therewithin in a circumferential direction and urges the ratchet plug 44 into one of the apertures 37, 38, or 39 in the sidewall 22 of the winch frame 20 during repositioning. The wave washer 29 is made of a resilient material, such as spring steel.

In the preferred embodiment of the winch mechanism 10 of the present invention, the pawl 60 and ratchet 40 are separate members, both members pivoting together on the ratchet-pawl axle 31 whenever the ratchet 40 is repositioned. Rotational movement of the pinion gear 70 in either direction is determined by the angular position of the pawl 60, which in turn is determined by the angular position of the ratchet 40.

To pay out the winch line 17 that is wound about the drum 30 such that its outer end can be attached to a boat, the winch mechanism of the present invention is in the free-spooling mode. The winch line 17 can then be grasped and extended as necessary. The drum 30 is free to rotate accommodating the pay out of the winch line 17. The winch mechanism 10 becomes engaged once the object to be hoisted is secured. The winch handle 11 is positively held in any of three predetermined modes to prevent inadvertent repositioning of the ratchet 40.

Figure 3:
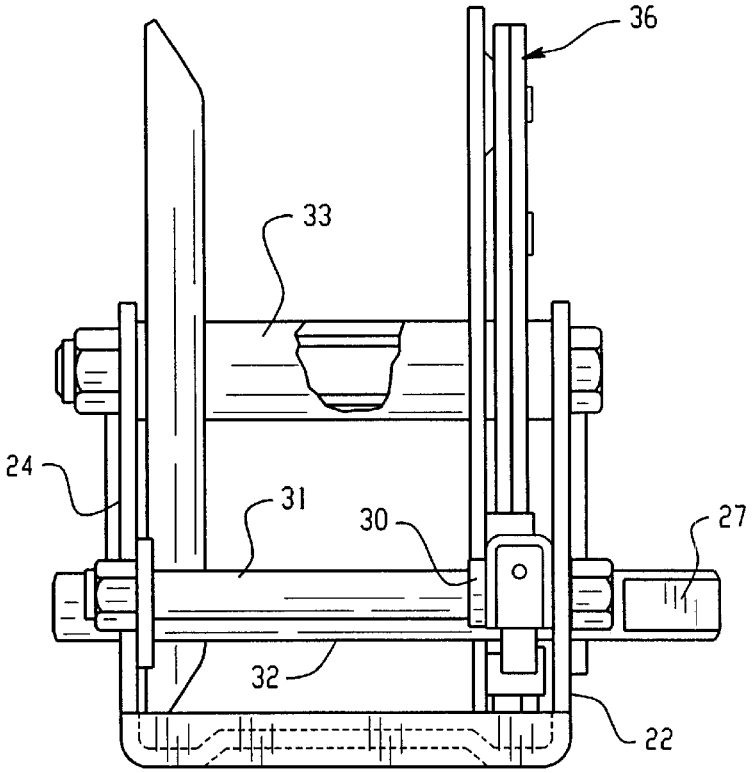
FIG. 3 is a top perspective view of the preferred embodiment of the winch mechanism of FIG. 1, the ratchet being in the engaged mode enabling only forward rotation of the pinion gear.

Referring now to FIGS. 3 and 5, the reverse-engagement mode is shown for the winch mechanism 10 of the present invention. In this mode, the ratchet plug 44 is positioned securely within the forward aperture 39 in the winch frame 20. The position of the ratchet arm 42 is essentially horizontal. The ratchet 40 is in the engaged mode, and the lower pawl tooth 64 is in engagement with the pinion gear 70. Only counterclockwise rotation of the pinion gear 70 is enabled (as viewed from FIG. 5), resulting in only clockwise rotation of the drum gear 36. Clockwise rotation of the pinion gear 70 is blocked by the position of the pawl 60.

Figure 6:
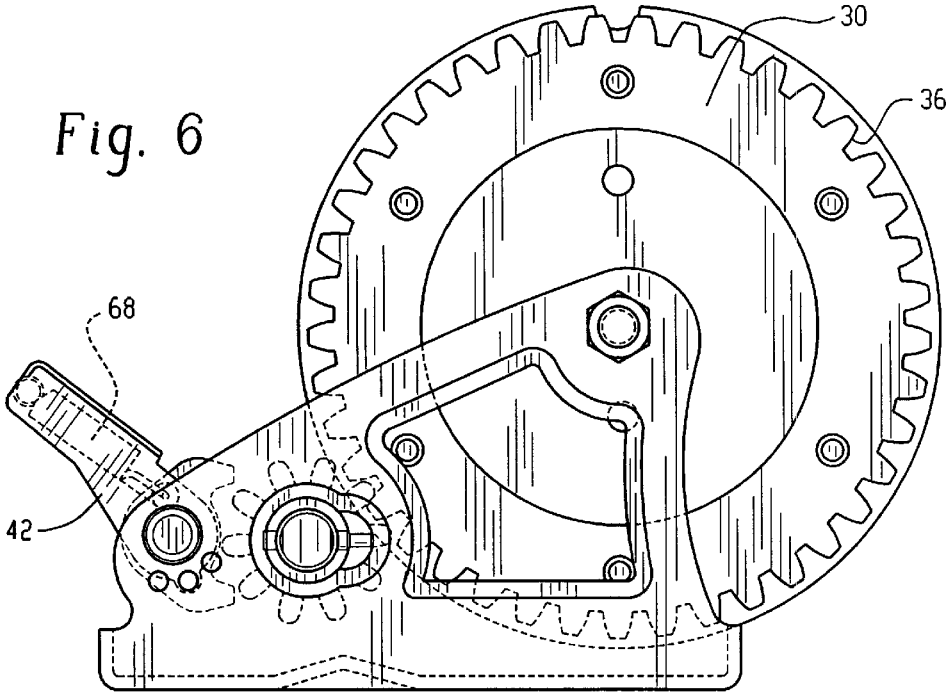
FIG. 6 is a side elevational view of the preferred embodiment of the winch mechanism of FIG. 1, the ratchet being in the disengaged mode enabling rotation in both forward and reverse rotation of the pinion gear.

FIG. 6 discloses the disengaged or free-spooling mode of the winch mechanism 10 of the present invention. In this mode, the ratchet plug 44 is securely positioned within the middle aperture 38 in the winch frame 20, and the position of the ratchet 40 is at about a forty-five degree angle. This enables a détente rotation of the pinion gear 70 and drum gear 36 enabling movement in either direction about their respective axes. When the pawl 60 is in the intermediate mode, both pawl teeth 62 and 64 are out of engagement with the pinion gear 70.

Figure 4:
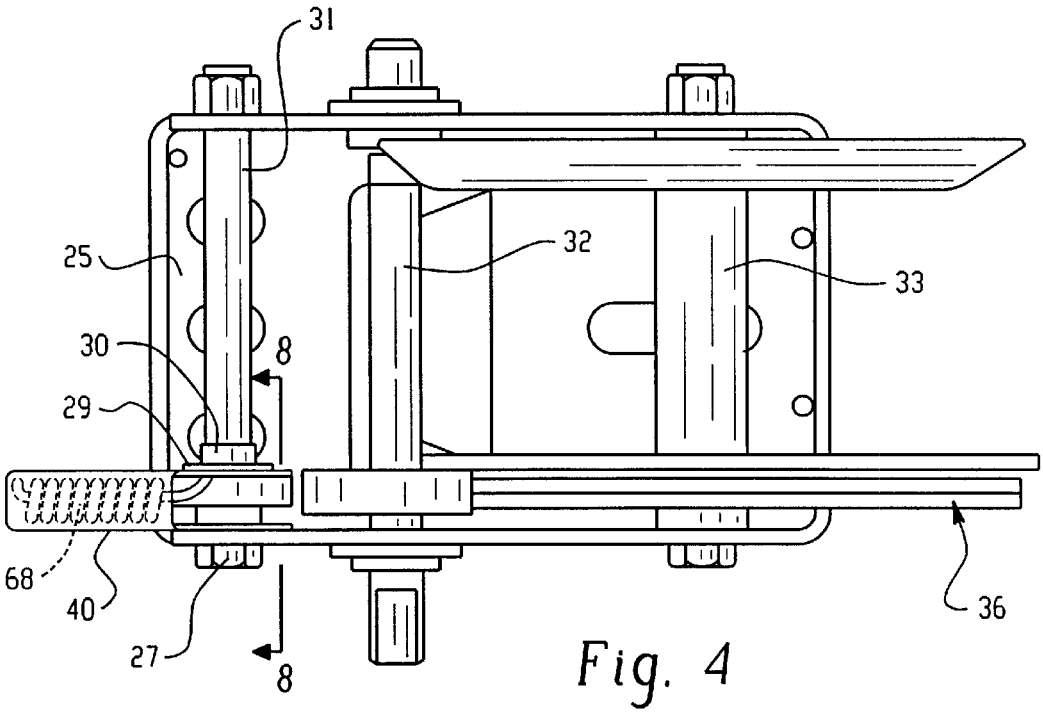
FIG. 4 is a top perspective view of the preferred embodiment of the winch mechanism of FIG. 1, the ratchet being in the engaged mode enabling only reverse rotation of the pinion gear.

FIGS. 4 and 7 disclose the forward-engagement mode for the winch mechanism 10 of the present invention. In this mode, the ratchet plug 44 is positioned securely with the rear aperture 37 in the sidewall 22 of the winch frame 20. The position of the ratchet arm 42 is essentially vertical. The ratchet 40 is again engaged as the upper pawl tooth 62 meshes with the pinion gear 70. Only counterclockwise rotation of the drum gear 36 is enabled as clockwise rotation is blocked.

While the preferred embodiment of the winch mechanism of the present invention includes three apertures 37, 38, and 39 in the sidewall 22 of the winch frame 20, various other configurations may be used, including additional apertures in the sidewall for additional positions of the winch mechanism, an elongated slot, or V-shaped slots (not shown). In these configurations, the single elongated aperture can be used for a plurality of modes.

It is evident that many alternatives, modifications, and variations of the winch mechanism 10 of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

What is claimed:

1. A winch mechanism for engagement with a pinion gear, the pinion gear being rotatable in a forward direction and a reverse direction, the winch mechanism comprising:

a frame having a pair of sidewalls including at least one aperture disposed in one sidewall, the at least one aperture being proximate to an axle opening in one of the sidewalls;

a ratchet including a ratchet arm and a ratchet plug, the ratchet arm enables repositioning of a pawl, the ratchet plug enables engagement of the ratchet with the frame; and the pawl having at least two teeth, the first tooth being in détente engagement with the pinion gear enabling a forward rotation of the pinion gear while blocking reverse rotation of the pinion gear, the second tooth being in détente engagement with the pinion gear enabling a reverse rotation of the pinion gear while blocking forward rotation of the pinion gear, each position of the ratchet and pawl position relative to the pinion gear being secured by détente engagement between the ratchet plug and one aperture of the at least one aperture.

2. The winch mechanism of claim 1, wherein there is one aperture in the frame for each position of the winch mechanism.

3. The winch mechanism of claim 1, further comprising a free-spooling mode that enables unblocked forward and reverse rotation of the pinion gear.

4. The winch mechanism of claim 1, further comprising a wave washer to urge the ratchet plug into an aperture upon repositioning of the ratchet relative to the frame.

5. The winch mechanism of claim 1, wherein the ratchet surrounds the pawl.

6. A winch mechanism for engagement with a pinion gear, the pinion gear being rotatable in a forward direction and in a reverse direction, the winch mechanism comprising:

a pawl including at least one engaging tooth for cooperative engagement with the pinion gear;

a ratchet including a ratchet arm and a ratchet plug, the ratchet arm enabling repositioning of the pawl, the ratchet plug enabling secure engagement of the ratchet in one of a plurality of discrete positions; and a frame having a pair of sidewalls and a base, the frame including a plurality of apertures being disposed in one sidewall, the plurality of apertures being proximate to each other, détente engagement of the ratchet plug within one of the plurality of apertures defining each discrete position of the ratchet for each mode of the winch mechanism.

7. The winch mechanism of claim 6, wherein when the ratchet plug is positioned in a first frame aperture, a first pawl tooth is in cooperative engagement with the pinion gear, forward rotation of the pinion gear being enabled and reverse of the pinion gear being blocked.

8. The winch mechanism of claim 7, wherein when the ratchet plug is positioned in a second frame aperture, a second pawl tooth is in cooperative engagement with the pinion gear, reverse rotation of the pinion gear being enabled and forward rotation of the pinion gear being blocked.

9. The winch mechanism of claim 8, wherein when the ratchet plug is positioned in a third frame aperture, the pawl is disengaged from the pinion gear, and forward and reverse rotation of the pinion gear is enabled.

10. The winch mechanism of claim 6, further comprising a wave washer to urge the ratchet plug into an aperture upon repositioning of the ratchet relative to the frame.

11. The winch mechanism of claim 6, wherein the ratchet surrounds the pawl.

12. A winch mechanism for engagement with a pinion gear, the pinion gear being rotatable in a forward direction and in a reverse direction, said winch mechanism comprising:

a pawl including at least one engaging tooth for selective engagement with the pinion gear;

a ratchet including a ratchet arm and a ratchet plug, said ratchet arm enabling repositioning of said pawl, said ratchet plug enabling secure engagement of said ratchet in one of a plurality of discrete positions; and a frame having a pair of sidewalls and a base, said frame including a plurality of apertures disposed in one sidewall corresponding to said discrete positions of said ratchet wherein détente engagement of said ratchet plug within each of said apertures defines each discrete position of said ratchet to selectively enable movement of the pinion gear in the forward and reverse direction.

13. The winch mechanism of claim 12, wherein when the ratchet plug is positioned in a first frame aperture, a first pawl tooth is in cooperative engagement with the pinion gear, forward rotation of the pinion gear being enabled and reverse of the pinion gear being blocked.

14. The winch mechanism of claim 13, wherein when the ratchet plug is positioned in a second frame aperture, a second pawl tooth is in cooperative engagement with the pinion gear, reverse rotation of the pinion gear being enabled and forward rotation of the pinion gear being blocked.

15. The winch mechanism of claim 14, wherein when the ratchet plug is positioned in a third frame aperture, the pawl is disengaged from the pinion gear, and forward and reverse rotation of the pinion gear is enabled.

* * * * *